US005341582A

United States Patent [19]

Liautaud

[11] Patent Number: 5,341,582

[45] Date of Patent: Aug. 30, 1994

[54] ANTI-SLIP DEVICE FOR FOOTWEAR

[75] Inventor: Jeffrey Liautaud, Park Ridge, Ill.

[73] Assignee: Sherpa, Inc., Walworth, Wis.

[21] Appl. No.: 42,797

[22] Filed: Apr. 6, 1993

[51] Int. Cl.[5] ..... A43C 15/06

[52] U.S. Cl. ..... 36/76; 36/62

[58] Field of Search ..... 36/59 R, 61, 62, 64, 36/65, 66, 7.6, 7.7, 122, 123, 124, 125

[56] References Cited

U.S. PATENT DOCUMENTS

| | | | |
|---|---|---|---|
| 1,039,928 | 10/1912 | Gray | 36/7.6 |
| 1,399,682 | 12/1921 | Bardon | 36/7.6 |
| 2,401,891 | 6/1946 | Smith | 36/62 |
| 2,738,596 | 3/1956 | Walsh | 36/62 |
| 2,769,250 | 11/1956 | Rinkinen | 36/124 |
| 3,095,657 | 7/1963 | Fradette | 36/7.6 |
| 3,182,407 | 5/1965 | Harde | 36/62 |
| 3,214,850 | 11/1965 | McNair | 36/62 |
| 3,229,389 | 1/1966 | Adams | 36/62 |
| 3,802,100 | 4/1974 | Prater | 36/124 |
| 4,302,890 | 12/1981 | Covell et al. | 36/62 |
| 4,344,238 | 8/1982 | Peyser | 36/62 |
| 4,620,375 | 11/1986 | Wallace | 36/7.6 |
| 4,910,883 | 3/1990 | Zock, Jr. | 36/62 |

OTHER PUBLICATIONS

Instruction Sheet for Cross-Country Ski Bindings by Sherpa, 2222 Diversey Pkwy., Chicago, Ill. 60647.

*Primary Examiner*—Steven N. Meyers

*Attorney, Agent, or Firm*—Breiner & Breiner

[57] ABSTRACT

An anti-slip device for use with footwear such as running shoes, snowshoes, boots and the like, is described. The anti-slip device is adjustable to fit to different sizes of footwear and is especially suitable for use on snow and ice covered surfaces. The anti-slip device includes a heel portion, a toe portion and one or more traction plates attached to the underside of the heel portion. The heel portion includes a tongue portion which provides additional traction and stability to the anti-slip device. The toe portion is adjustable in relation to the heel portion through the use of a plurality of mating serrations and alignable apertures. A fastening means is attached to the heel portion and the toe portion to provide for attachment of the anti-slip device to footwear. If desired, the traction plate utilized with the anti-slip device can be hingedly connected to a snowshoe frame. Additionally described is a footwarmer/protector utilizable with the anti-slip device of the invention or with conventionally known snowshoe bindings or traction devices.

7 Claims, 3 Drawing Sheets

ANTI-SLIP DEVICE FOR FOOTWEAR

FIELD OF THE INVENTION

The present invention is directed to an anti-slip device for footwear, such as running shoes, snowshoes, boots and the like. The anti-slip device is adjustable so as to be usable with and fit to different sizes of footwear. The anti-slip device is especially suited for use on snow and ice covered surfaces. The anti-slip device of the present invention provides safety in traversing slippery surfaces generally.

BACKGROUND OF INVENTION

Anti-slip devices for use with existing footwear are desirable especially in the winter to provide safety and mobility on snow, ice or other slippery surfaces. It is particularly desirable to provide anti-slip devices which can be readily attached to conventional running shoes, boots and the like, in particular, which are not restricted by the size of the footwear. This allows for the use of footwear with which a user is familiar and comfortable. Such is further an advantageous feature in regard to snowshoes. Snowshoes not requiring specialized footwear are less expensive and more readily available for use by different users.

One known device for providing traction to footwear is described in U.S. Pat. No. 4,525,939. Additionally, snowshoes having a cleated footplate are known in the art which can be used without a specialized boot due to the use of bindings on the snowshoes, as shown in U.S. Pat. No. 3,802,100. Further, adjustable shoe receiving devices are known in the art for use in relation to skis. Such devices, however, are not shown to be useful as a traction device and are used with support across the entire underside of the device.

The structure of the prior art traction devices, therefor, are controlled by the type of use to which the traction device is put and do not provide interchangability with various uses. Further, to the extent the prior art traction devices are adjustable to fit different sizes of footwear, the structures required are specialized resulting in a more complex and, therefore more costly, manufacturing processes. Additionally, traction for climbing inclines is lacking due to the absence of a traction means on the forward end of the footwear. Further, no means of providing added warmth or protection to the footwear used with such prior art devices is described for use with such devices.

OBJECTS OF THE INVENTION

A primary object of the present invention is to provide an anti-slip device for footwear which is adjustable to fit differing sizes of footwear while providing traction to a user of the footwear.

Another primary object of the present invention is to provide an anti-slip device which is usable with conventional running shoes, boots and the like.

Another primary object is to provide an anti-slip device usable with a snowshoe frame.

Another primary object of the present invention is to provide a footwarmer or protection attachment for footwear usable in combination with the anti-slip device of the invention or with other conventionally known traction or snowshoe foot-receiving devices.

BRIEF DESCRIPTION OF THE INVENTION

The anti-slip device for footwear of the present invention includes a heel portion with a tongue portion, a toe portion and at least one traction plate attached to the underside of the tongue portion. The heel portion includes a tongue portion which also provides traction to the anti-slip device. The anti-slip device can be used alone or in combination with a snowshoe frame.

More specifically, the heel portion includes an upstanding rear heel engaging flange or heel cup and a tongue portion having a plurality of serrations in its upper surface and apertures formed therein. A fastening means, such as a strap means, is also attached to the heel portion of the anti-slip device. The toe portion includes a base having an underside with a plurality of serrations formed therein. The toe portion additionally includes two upstanding members, one attached to each sidewall of the base. The upstanding members are constructed and arranged to hold a fastening means for the toe portion, such as a strap means. Additionally, the base of the toe portion has at least two apertures formed therein which are alignable with at least two of the apertures formed in the tongue portion of the heel portion of the anti-slip device. The toe portion and heel portion are held together by a fastening means, such as a nut and bolt or the like, which extends through the aligned holes of the toe portion and tongue portion. Stability and strength is provided to the attachment of the toe portion to the heel portion by the serrations of the tongue portion which are complementary to the serrations in the toe portion. The serrations mate when the toe portion is positioned in relation to the tongue portion to prevent slipping and proper fitting of the toe portion and tongue portion in relation to each other. At least one traction plate is attached to the underside of the heel portion. The traction plate includes a plurality of downwardly extending cleats, which are preferably serrated to provide better gripping on a slippery surface.

When the anti-slip device is utilized with footwear, such as a running shoe, boot or the like, preferably two traction plates are utilized. One traction plate is positioned towards the back end of the device while the other is positioned toward the front end of the device. When the anti-slip device is used with a snowshoe frame, a single traction plate is, preferably, hingedly connected to a snowshoe frame such as described in U.S. Patent No. 3,802,100. The anti-slip device of the present invention is utilized with the snowshoe frame and traction plate described in the '100 patent rather than the binding arrangement described in the '100 patent.

In use of the anti-slip device, traction is provided to a user by the traction plate attached to the underside of the heel portion as well as by the tongue portion of the heel portion. The tongue portion extends partially beyond the toe portion and, accordingly, upon forward movement and downward pressure by a use of the anti-slip device the tongue portion will also extend inward toward the snow or ice covered surface to provide contact and gripping, i.e., traction.

The invention additionally provides a footwarmer/-protector for footwear which is usable in combination with the anti-slip foot device of the present invention or with conventionally known traction or snowshoe structures which require the insertion of a shoe or boot, such as shown in U.S. Pat. Nos. 3,802,100 and 4,525,939.

The footwarmer/protector is made of a flexible insulative material which, preferably, provides both warmth and water resistance to footwear. The footwarmer/protector is utilized to partially cover the footwear of a user and, in particular, to cover laces which may be present in the footwear in order to prevent snow or ice from becoming encrusted in the laces and melting into the footwear.

The flexible insulative material is essentially planar and has a front side and a rear side. The flexible material includes a main body portion with a fastening means attached to the rear side of the material adjacent each side edge of the main body portion. The main body portion also includes a first end to which a first strap or tab means and a second strap or tab means is attached. Each of the strap means includes a first end and a second end wherein each of the first ends are attached to the first end of the main body portion and each of the second ends are free and have a fastening means attached to the front side thereof. The footwarmer/protector additionally includes two depending portions attached to a second end of the main body portion of the footwarmer/protector. The ends of the depending portions not attached to the main body portion are free and unattached when not in use. One of the depending portions has a fastening means attached to the rear side of its free end while the other depending portion has a fastening means attached to the front side at its free end.

In use, the free end containing the fastening means of the first strap means is extended and attached to the fastening means attached to the adjacent side wall of the main body portion and the free end containing the fastening means of the second strap means is extended and attached to the fastening means attached to the adjacent sidewall of the main body portion. This attachment arrangement provides for the formation of a toe-receiving portion in the footwarmer/protector. When the footwarmer/protector is positioned on footwear, the top of the toe of the footwear is positioned in the formed toe-receiving portion of the footwarmer/protector, the first and second depending portions are then wrapped around the sides of the footwear so that they overlap behind the heel of the footwear and the fastening means of the first depending portion becomes attached to the fastening means of the second depending portion. The length and width of the depending portions are provided so that they are sufficient to extend behind the heel of the footwear and overlap. The rear side of the main body portion then serves to cover the top exposed surface of the footwear, in particular the portion containing laces. A preferred fastening means useful with the footwarmer/protector of the present invention are fastening tapes having complementary hook and pile pieces which interlock, such as conventionally known and available under the tradename VELCRO.

The footwarmer/protector of the invention is preferably adjusted to fit around the footwear prior to placement of the footwear in the anti-slip device.

BRIEF DESCRIPTION OF THE DRAWINGS

FIG. 6 is a bottom plan view of the anti-slip device of the invention as shown in FIG. 1 having two traction plates attached to the underside of the heel portion for use of the anti-slip device with running shoes, boots, and the like.

DETAILED DESCRIPTION OF THE PRESENTLY PREFERRED EMBODIMENTS

Figure 1:
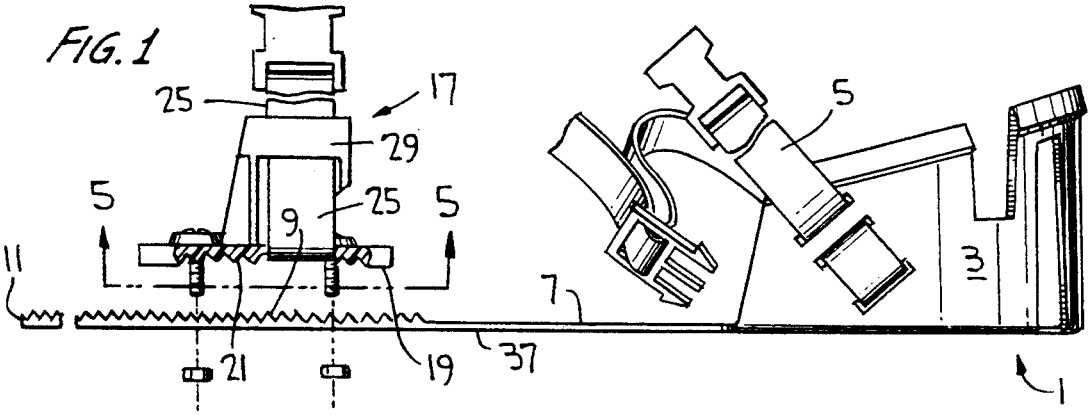
FIG. 1 is a side view of the heel portion and toe portion of the anti-slip device in spaced apart relation without any traction plate attached thereto.
Figure 2:
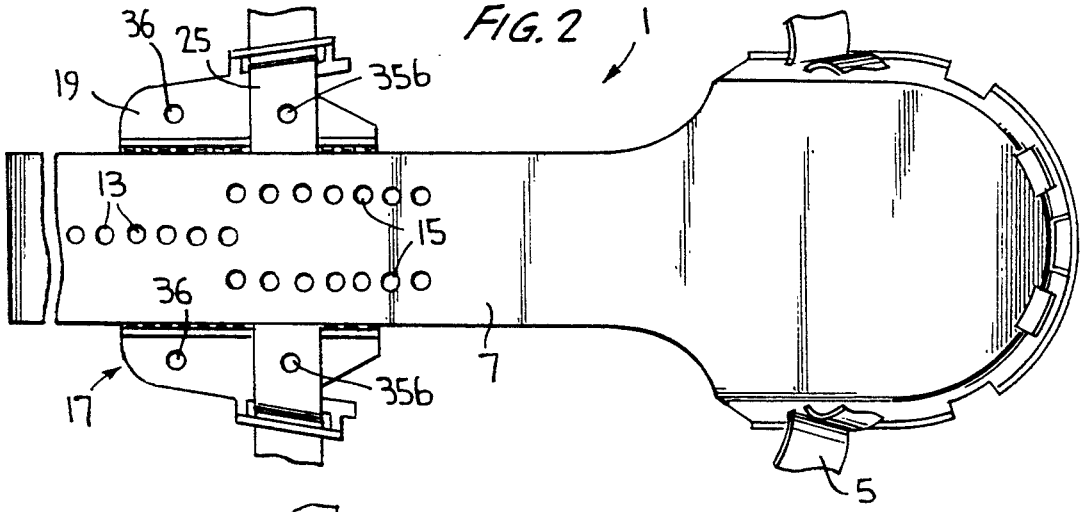
FIG. 2 is a bottom plan view of the anti-slip device of the present invention as shown in FIG. 1.
Figure 3:
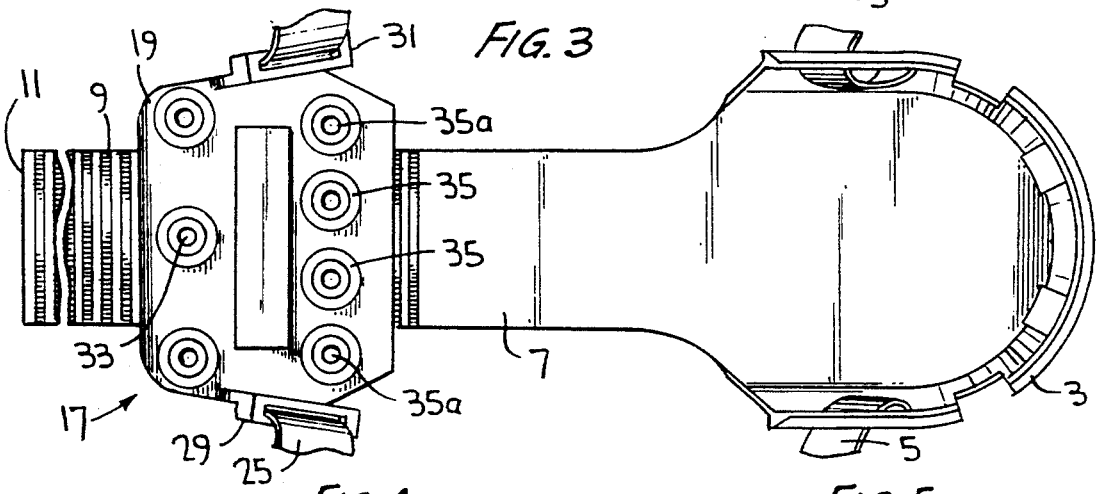
FIG. 3 is a top plan view of the anti-slip device as shown in FIG. 1.
Figure 4:
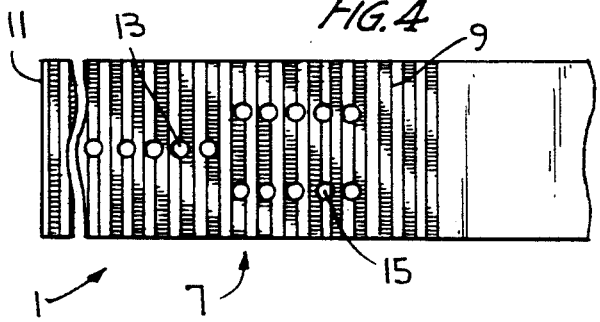
FIG. 4 is a partial top plan view of the tongue portion of the heel portion of the anti-slip device as shown in FIG. 1.

The anti-slip device for footwear of the present invention includes a toe portion, a heel portion and one or more traction plates. The heel portion includes a tongue portion integral therewith. The anti-slip device can be used as is with footwear to provide traction for the footwear. The tongue of the heel portion is used for traction uphill by knifing the tongue portion into the snow as an extension of the foot. Alternatively, the traction plate can be attached to a snowshoe frame to serve as a footwear-receiving member for the snowshoe thereby providing the snowshoe with improved traction and making the snowshoe usable with varying types and sizes of footwear.

The heel portion and toe portion of the anti-slip device is shown in FIGS. 1–5. FIGS. 6–10 show the structure of FIGS. 1–5 utilized with one or more traction plates so as to provide an anti-slip device useful alone or in combination with a snowshoe structure.

More specifically, the anti-slip device of the present invention includes a heel portion 1 including an upstanding rear heel engaging flange or heel cup 3 having a fastening means 5 attached thereto. The fastening means can be in the form of a strap with a snap, buckle or the like. Preferably, the strap means is a nylon mesh with a plastic snap attachment. The heel portion 1 additionally includes a tongue portion 7 which on its top surface includes a plurality of serrations 9. The length of tongue portion 7 will be such so that the distance between heel cup 3 and the free end 11 of tongue portion 7 allows for the seating or insertion of various sizes of footwear therein and provide length to extend beyond toe portion 17 once footwear has been fitted to the anti-slip device. Additionally present in tongue portion 7 are a plurality of apertures 13 and 15. Apertures 13 and 15 are utilized in relation to toe portion 17 and traction plate 53 or 63 as further described below.

Toe portion 17 includes a base 19 including, over at least a portion of the length of the underside thereof, a plurality of serrations 21. In a preferred embodiment, the serrations are divided by an area 23 not containing serrations so as to allow a fastening means 25 in the form of a strap to pass therethrough, as further described below. Preferably, positioned at the ends of serrations 21 are guide rails or bars 27 which serve as a guide and retaining means for tongue portion 7. Accordingly, guide rails 27 are spaced apart at a distance just greater than the width of tongue portion 7 so that tongue portion 7 sits snugly between guide rails 27 when the toe portion and heel portion are attached. Toe portion 17 additionally includes two upstanding members 29 and 31 which provide support for the toe end of footwear held in the anti-slip device and support for a fastening means, such as strap means 25, which is utilized in conjunction with fastening means 5 to retain footwear in the anti-slip device during use of the device. Strap means 25 preferably includes a snap, buckle or the like, and is most preferably a nylon mesh strap having a plastic snap attachment.

Additionally present in toe portion 17 are at least two apertures which extend through base 19 and are positioned to be alignable with apertures 13 and **35*a* or 36 present in tongue portion 7. Preferably, base 19 includes an aperture 33 which is alignable with one of apertures 13 and additionally contains apertures 35*a* and 36 which are alignable with apertures contained in a traction plate attached to the underside of tongue portion 7 and base 19. Fastening means, such as nuts and bolts or the like, are used in the aligned apertures to fasten toe portion 17 to tongue portion 7. Additionally, as further described below, the fastening means extending through apertures 35*a* and 36**, preferably also extend through the traction plate used with the toe portion and heel portion to attach the traction plate to the heel portion.

Figure 5:
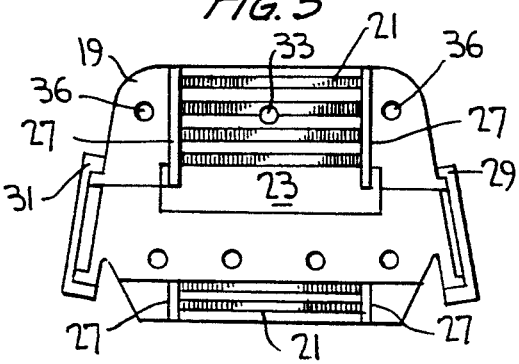
FIG. 5 is a bottom plan view of the toe portion of the anti-slip device without the fastening means.

In use, to fit the anti-slip device to a specific size of footwear, toe portion 17 is slid in relation to tongue portion 7 so that base 19 is positioned approximately beneath the ball portion of the footwear. Serrations 9 will mate with complementary serrations 21 to provide stability to toe portion 17 in relation to heel portion 1. A fastening means, such as a nut and bolt, is inserted through hole 33 and the hole 13 which is aligned with hole 33 to fasten toe portion 17 to tongue portion 7 in a firm manner. Additional support is provided by providing a fastening means, such as a nut and bolt, through aligned holes **35*a* and 36. Further support may also be provided by passing a fastening means through aligned apertures 35 and 15. Any combination of use of the aligned apertures is possible as long as the tongue portion, toe portion and traction plate are securely affixed to each other. When toe portion 17 is attached to heel portion 1, strap 25 which extends across the underside of base 19, as shown in FIG. 5, is positioned between tongue portion 7 and toe portion 17. The open area 23 in the underside of base 19 provides a seat for strap means 25 so toe portion 17 can sit flush or smoothly in relation to tongue portion 7. Holes 35*b* are provided in the strap means and correspond to aligned hole 35*a* in base 19. Once the desired position of toe portion 17 is determined, any excess length of tongue portion 7 extending beyond approximately 1.0 to 1.25 inches beyond toe portion 17 can be severed and removed from the anti-slip device. The anti-slip device is preferably made of a hard plastic to allow for sawing off of the tongue portion. The severance can be made at a low point in the serrations thereby lessening the thickness which must be cut. The extension of the tongue portion 7 beyond toe portion 17 is required to provide added traction to the anti-slip device. The extended tongue portion is available to provide additional gripping and contact surface to an inclined snow or ice covered surface when a user knifes the tongue portion into the incline to move upward. The extended tongue portion provides for further traction uphill. Because the angle of the tongue portion is in line with the foot, it provides traction beyond that provided by a traction plate attached to the underside of the tongue portion. Accordingly, the extended tongue portion improves upon the degree or amount of traction provided by the anti-slip device of the invention. Excessive length to tongue portion 7 once fitted to footwear, however, is undesirable since it can impede easy movement of the user of the anti-slip device when walking. As set forth above, a preferred length is about 1¼ inches beyond the toe portion 17**.

Figure 6:
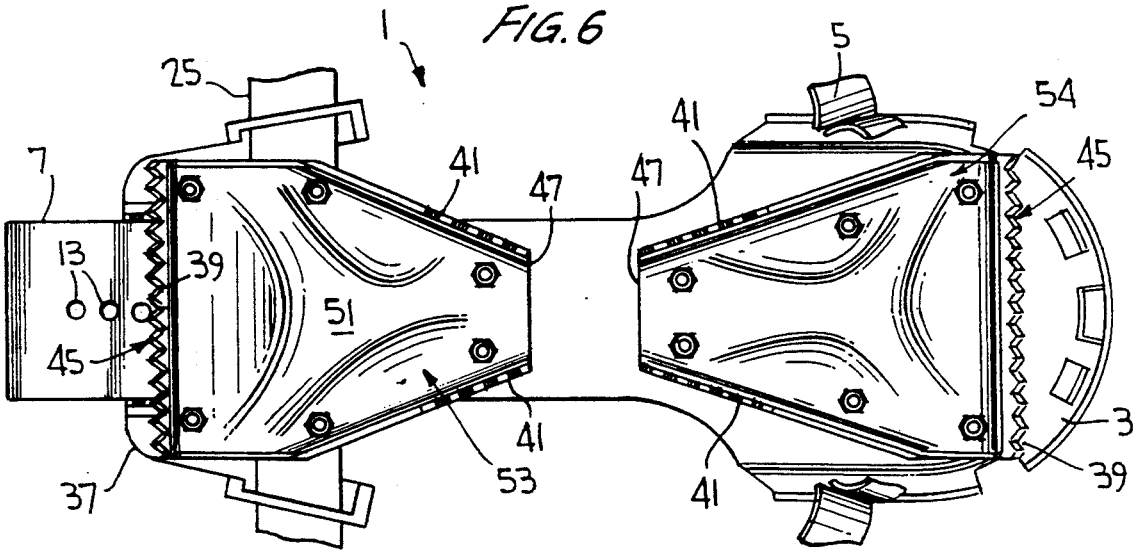
Figure 8:
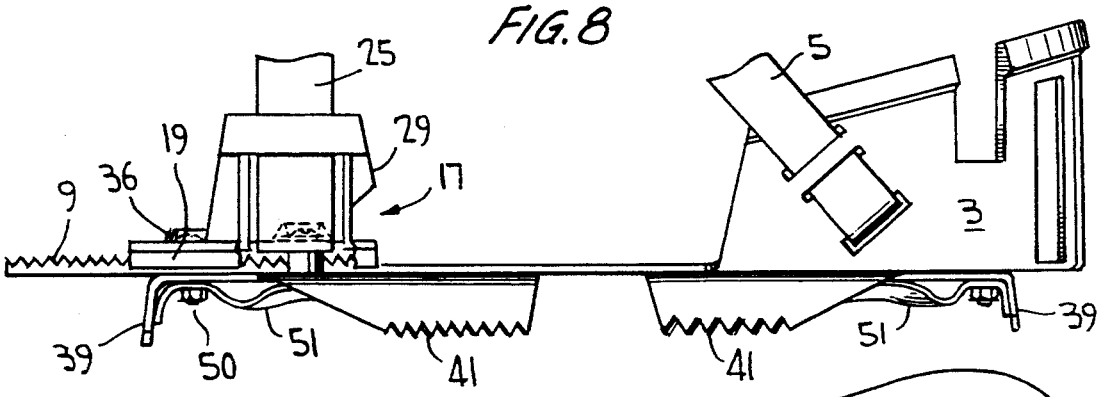
FIG. 8 is a side view of the anti-slip device as shown in FIG. 6.

When the anti-slip device of the present invention is to be utilized with footwear such as a running shoe or boot for the purpose of normal walking or running, one or more traction plates are attached to the underside 37 of heel portion 1 as shown, for example, in FIGS. 6 and 8.

Figure 7:
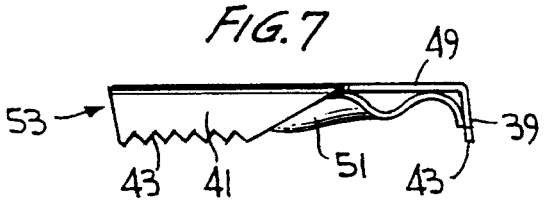
FIG. 7 is a side view of a single traction plate suitable for use in the invention and as shown in FIGS. 6 and 8–10.

A traction plate which is preferably used with the anti-slip device of the present invention is shown in FIGS. 6–8 and is rigid, preferably made of metal such as aluminum alloy, and includes downwardly projecting cleats. The cleats, preferably, extend crosswise 39 in the plate and extend generally lengthwise 41 along the sides of the traction plate. The cleats are also preferably serrated at their ends 43 to provide for better gripping in snow or ice. The traction plates additionally preferably include a diverging end 45 and a converging end 47. When two traction plates are utilized with the anti-slip device as shown in FIG. 6, the converging ends are positioned to be present in the front and rear of the anti-slip device. When one traction plate is utilized, as described below in relation to the embodiment shown in FIGS. 9 and 10, the converging end is preferably present at the front end of the anti-slip device so as to act in a claw-like manner and provide for the most expansive initial gripping and holding to a snow or ice covered surface.

Additionally, the traction plate can include flexible sheeting 51 attached to the underside 49 of the traction plate. Flexible sheeting 51 preferably is puffed or spaced from underside 49, as best shown in FIG. 7, so that the weight of the user of the anti-slip device bears upon the flexible sheeting in use causing the sheeting to move relative to the traction plate. This results in the loosening of any snow or ice which may become attached to the underside of the traction plate. The flexible sheeting at one end, as denoted by 50 in FIG. 8, is held to the traction plate by the same fastening means which fastens the traction plate to heel portion 1 of the anti-slip device. Preferably, fastening means, such as nuts and bolts, pass through aligned apertures **35*a*, 35*b* and 36. Accordingly, a common fastening means joins toe portion 17, tongue portion 7, traction plate 53 and flexible sheeting 51. Additional fastening means used to hold plate 53 or additional plate 54 as shown in FIG. 6 can be nuts and bolts or the like and are attached to heel portion 1** at a point adjacent the traction plate.

Figure 9:
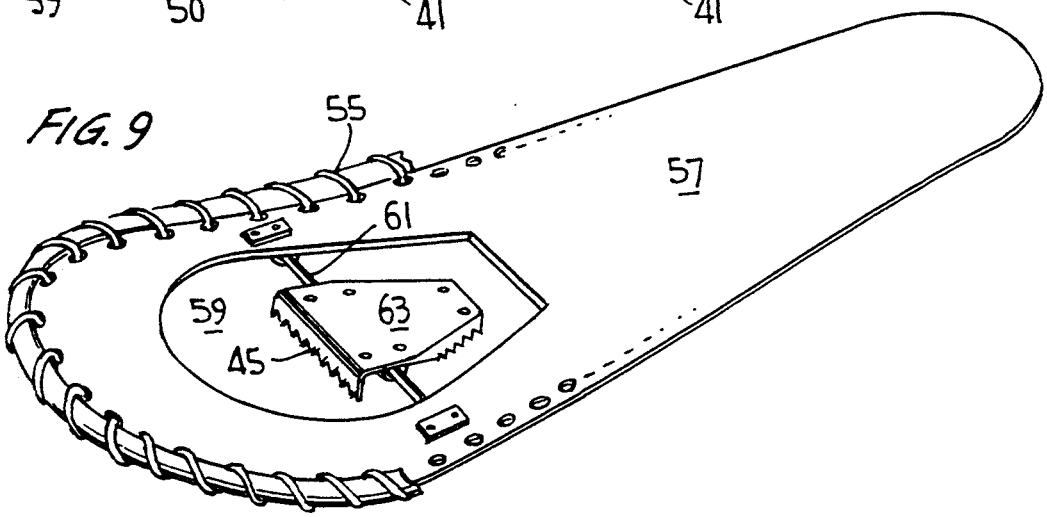
FIG. 9 is a perspective view of a snowshoe frame having a single traction plate hingedly connected to the snowshoe frame which is suitable for attachment to the heel portion of the anti-slip device of the present invention.
Figures 10, 11, 12, 13, 14, 15:
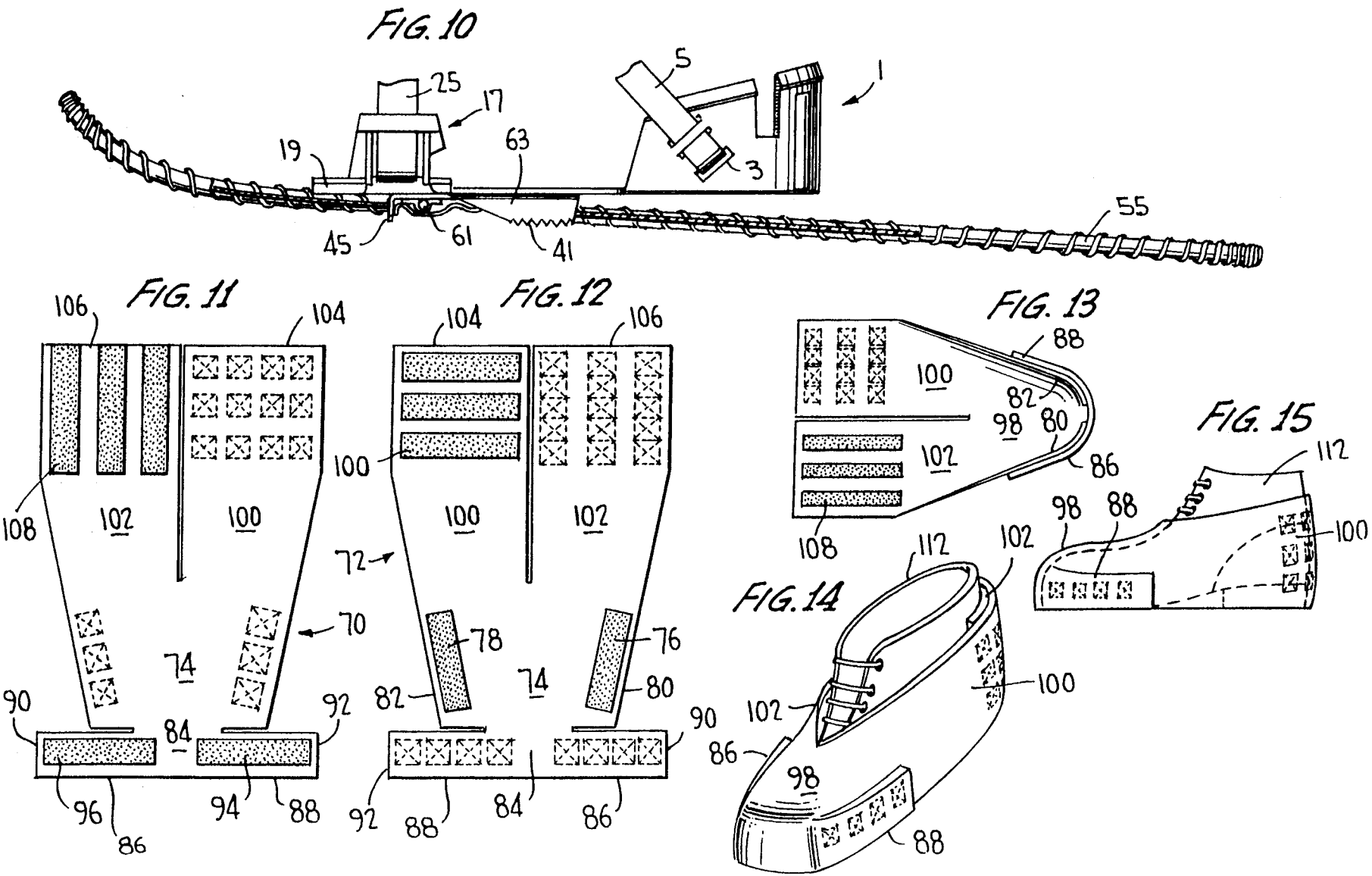
FIG. 10 is a side view of the anti-slip device as present with a snowshoe frame as shown in FIG. 9.
FIG. 11 is a plan view of the front side of the footwarmer/protector of the present invention.
FIG. 12 is a plan view of the rear side of the footwarmer/protector of FIG. 11.
FIG. 13 is a top plan view of the footwarmer/protector of FIGS. 11 and 12 wherein the two strap means are attached to the fastening means present in the main body portion of the footwarmer/protector in order to form a toe-receiving portion.
FIG. 14 is a perspective view of the footwarmer/protector of FIGS. 11–13 attached to footwear.
FIG. 15 is a side view of the footwarmer/protector attached to footwear.

As shown in FIGS. 9 and 10, an alternative embodiment involves the traction plate being hingedly connected to a snowshoe frame. A suitable snowshoe frame having a traction plate hingedly connected thereto is described in U.S. Pat. No. 3,802,100 which is incorporated herein by reference. In the embodiment shown in FIGS. 9 and 10, the traction plate which is hingedly connected to snowshoe frame 55 is connected to the underside of heel portion 1 in the same manner as the forward traction plate 53 described in relation to FIGS. 6 and 8.

Briefly, the snowshoe frame 55 includes, preferably, plastic sheeting 57 having an opening 59 therein. A bar 61 crosses opening 59 and has hingedly attached thereto a traction plate 63 having a structure as shown in FIG. 7 and described in relation to traction plate 53 in FIG. 6. The section of the anti-slip device corresponding to the ball portion of the footwear is positioned approximately above the converging end 45 of plate 63. Heel portion 1 of the anti-slip device is attached to plate 63 through means of fasteners, such as nuts and bolts or the like, as described above. Due to opening 59 in the snowshoe frame, the extended tongue portion 7 of the anti-slip device is allowed to come in contact with the ground surface and provide for added traction as set forth above in relation to the previously described embodiment. The traction, accordingly, is provided to the snowshoe from two different points to provide for improved traction as compared to devices with traction solely present on the base of snowshoes.

The use of the anti-slip device in combination with a snowshoe is advantageous in that the protruding tongue of the heel portion provides traction. Additionally, the anti-slip device of the present invention allows for the user to utilize footwear which is comfortable and familiar to the user.

The present invention is also directed to providing a footwarmer or protector for use with the anti-slip device of the invention or for use with conventionally known snowshoe bindings or traction devices such as shown in U.S. Pat. Nos. 3,802,100 and 4,525,939. The footwarmer/protector of the present invention is shown in FIGS. 11–15.

More particularly, the footwarmer/protector of the present invention is preferably made of a flexible insulative material as known and commercially available. The insulative material preferably provides heat insulation as well as water-resistance. The footwarmer/protector includes a front side 70 as shown in FIG. 11 and a rear side 72 as shown in FIG. 12. The footwarmer/protector includes a main body portion 74 having fastening means 76 and 78 attached to rear side 72 adjacent side edges 80 and 82, respectively. Main body portion 74 also includes first end area 84. Extending from end area 84 is a first strap or tab means 86 and a second strap or tab means 88. Strap means 86 and 88 have, respectively, free ends 90 and 92. Attached to front side 70 of free ends 90 and 92 are fastening means 94 and 96. The fastening means utilized in relation to the footwarmer/protector of FIGS. 11–15 preferably are of a fastening tape-type which includes opposing pieces of fabric having interlocking hook and pile, such as known in the art by the tradename VELCRO. As shown in FIGS. 11–15, the fastening means are sewn to the flexible insulative material. The fastening means used with the footwarmer/protector, however, can also be attached by other suitable means such as an adhesive or the like. In use, fastening means 94 and 96 are attached, respectively, to fastening means 78 and 76 as shown in FIG. 13 to form a toe-receiving area 98. Accordingly, fastening means 96 are complementary to fastening means 76 and fastening means 94 are complementary to fastening means 78, i.e., when utilizing a fastening tape such as VELCRO, one fastening means will be a hook portion and the other fastening means will be a pile portion to provide interlocking of the different fastening means when joined.

The footwarmer/protector additionally has attached to a second end 85 of main body portion 74 a first depending portion 100 and a second depending portion 102. Each depending portion 100 and 102 has a free end 104 and 106 respectively. Attached to front side 70 of depending portion 102 are fastening means 108. Attached to rear side 72 of depending portion 100 are fastening means 110. Fastening means 108 and 110 are complementary to each other to provide interlocking and are preferably present as one or more strips of fastening tapes of the type described above in relation to fastening means 96 and 76 or 78 and 94.

As set forth above, when the footwarmer/protector is utilized in conjunction with footwear, strap means 86 and 88 are bent or extended so that fastening means 94 and 96 are attached, respectively, to fastening means 78 and 76 to form toe-receiving portion 98. In use with footwear, such as for example indicated by 112 in FIGS. 14 and 15, the toe of the footwear is positioned in toe-receiving portion 98. Main body portion 74 then covers the top exposed surface of the footwear, including any laces which may be present. Thereafter, depending portions 100 and 102 are wrapped around the sides of footwear 112 and are caused to overlap across the rear heel area of footwear 112 so that fastening means 108 and 110 interlock and thereby cause depending portions 100 and 102 to cover the sides and heel of footwear 112 as shown in FIGS. 14 and 15.

The footwarmer/protector is especially useful when running shoes or other shoes having a lace portion on the upper surface is worn. The footwarmer/protector by means of main body portion 74 serves to cover the lace portion as indicated in FIGS. 14 and 15 and thereby prevent snow or ice from collecting in the laces and melting into the footwear. This serves to maintain the warmth and dryness of the foot of the user of the footwarmer/protector as well as preventing a buildup of snow or ice in the laces which can impede the removal of the footwear at a later time.

As will be apparent to one skilled in the art, various modifications can be made within the scope of the aforesaid description. Such modifications being within the ability of one skilled in the art form a part of the present invention and are embraced by the appended claims.

It is claimed:

1. An anti-slip device for footwear comprising:

(a) a heel portion including an upstanding heel engaging flange and a tongue portion having formed therein a plurality of serrations and a plurality of apertures wherein the tongue portion is of a length sufficient to extend beyond a toe portion of said anti-slip device to provide traction for the anti-slip device;

(b) said toe portion having a base with an underside having a plurality of serrations formed therein, a first upstanding member attached to a first side wall of the base, a second upstanding member attached to a second side wall of the base, and at least two aperatures formed in said base which are positioned so as to be alignable with at least two of the plurality of aperatures formed in said tongue portion;

(c) a means of fastening said toe portion to said tongue portion;

(d) a first fastening means attached to said upstanding heel engaging flange constructed and arranged to retain footwear in said heel portion;

(e) a second fastening means attached to said toe portion constructed and arranged to retain a toe end of footwear in said toe portion; and (f) at least one traction plate attached to the tongue portion, said traction plate having a plurality of exposed downwardly extending cleats in relation to the heel portion.

2. An anti-slip device according to claim 1 wherein said traction plate is attached to a snowshoe frame.

3. An anti-slip device according to claim 1 wherein said device is made of plastic and said tongue portion is severable.

4. An anti-slip device according to claim 1 wherein said downwardly extending cleats are serrated.

5. An anti-slip device according to claim 1 wherein said plurality of serrations in said toe portion are positioned between a first guide rail and a second guide rail present in a spaced relation at a distance greater than the width of the tongue portion of said heel portion.

6. An anti-slip device according to claim 1 wherein said at least one traction plate is lined with a sheet of flexible material.

7. An anti-slip device according to claim 1 wherein said downwardly extending cleats of said at least one traction plate are arranged lengthwise and at the side edges of said plate.

* * * * *